US010327533B2

(12) United States Patent
Cicchetti

(10) Patent No.: US 10,327,533 B2
(45) Date of Patent: Jun. 25, 2019

(54) CONTAINER DEVICE FOR COSMETICS

(71) Applicant: COSMEI S.r.L., Crema (Cremona) (IT)

(72) Inventor: Michele Cicchetti, Pandino (IT)

(73) Assignee: COSMEI S.r.L., Crema (Cremona) (IT)

( * ) Notice: Subject to any disclaimer, the term of this patent is extended or adjusted under 35 U.S.C. 154(b) by 243 days.

(21) Appl. No.: 15/053,352

(22) Filed: Feb. 25, 2016

(65) Prior Publication Data

US 2017/0245622 A1 Aug. 31, 2017

(51) Int. Cl.
*A45D 33/00* (2006.01)
*A45D 40/22* (2006.01)

(52) U.S. Cl.
CPC ..... *A45D 40/222* (2013.01); *A45D 33/003* (2013.01); *A45D 40/221* (2013.01); *A45D 2040/224* (2013.01)

(58) Field of Classification Search
CPC .. A45D 40/222; A45D 40/221; A45D 33/003; A45D 2040/224
USPC ..... 220/4.23, 839; 132/293, 301
See application file for complete search history.

(56) References Cited

U.S. PATENT DOCUMENTS 4,518,092 A 5/1985 Contreras, Sr.
5,161,556 A * 11/1992 Audebourg ..... A45D 40/22 132/296
2002/0162565 A1* 11/2002 Sebban ..... A45D 40/221 132/293
2003/0183240 A1 10/2003 Manougian et al.
2004/0238554 A1* 12/2004 Bosworth, Sr. ..... A45D 33/008 220/835
2009/0272399 A1* 11/2009 Kim ..... A45D 33/008 132/293
2014/0261533 A1 9/2014 Brock

FOREIGN PATENT DOCUMENTS

EP 3150078 A1 * 4/2017 ..... A45D 33/00

OTHER PUBLICATIONS

Italian Search Report for corresponding Italian Application No. MI20140562, completed Dec. 1, 2014, two pages.
European Search Report for corresponding EP Application No. 15 18 8015; three pages; search completed on Mar. 9, 2016.

* cited by examiner

*Primary Examiner* — James N Smalley
(74) *Attorney, Agent, or Firm* — Vorys, Sater, Seymour and Pease LLP

(57) ABSTRACT

Provided is a container device for cosmetics, including a containing portion including a cavity configured to contain a capsule constituting the cosmetic material, a cover portion configured to cover the containing portion, a hinge connecting the cover portion to the containing portion, wherein the containing portion, the cover portion and the hinge are made of silicone and are made as a single piece, and wherein the hinge consists of a thin connecting portion of the containing portion and the cover portion.

13 Claims, 3 Drawing Sheets

CONTAINER DEVICE FOR COSMETICS

FIELD OF THE INVENTION

The present invention relates to a container device for cosmetics comprising a containing portion including a cavity suitable to contain a capsule constituting said cosmetic material, a cover portion suitable to cover the containing portion, a hinge connecting the cover portion to the containing portion.

DESCRIPTION OF THE PRIOR ART

Container devices for cosmetics are currently known of, such as devices containing capsules and the like.

Said capsules are disc-shaped elements made from compacted powder elements included in a metallic support.

Said container devices thus comprise a containing portion suitable to contain said capsule and a cover portion, opposite the containing portion and suitable to close on the containing portion, covering it completely. The two portions are made of polymeric material such as PVC or similar and are connected to each other by a metal hinge.

Similar containers are disclosed in patent applications: US-A-2003/183240 and U.S. Pat. No. 4,518,092.

The prior art mentioned above has several significant drawbacks.

In fact, said container devices of the prior art are fragile. In particular they are not sufficiently resistant to being dropped and comprise a hinge which breaks easily.

Moreover, said container devices usually contain therein a mirror, preferably glass, which is also subject to breaking when dropped.

In addition said devices are expensive.

SUMMARY OF THE INVENTION

In this situation the technical purpose of the present invention is to devise a container device for cosmetics able to substantially overcome the drawbacks mentioned above.

Within the sphere of said technical purpose one important aim of the invention is to provide a container device for cosmetics which is resistant.

Another important purpose of the invention is to design a container device for cosmetics which helps to protect fragile items inside it, such as mirrors and the like.

A further purpose of the invention is to obtain a container device for cosmetics which is simple and cheap.

The technical purpose and specified aims are achieved by a container device for cosmetics comprising a containing portion including a cavity suitable to contain a capsule constituting the cosmetic material, a cover portion suitable to cover the containing portion, a hinge connecting the cover portion to the containing portion, wherein the containing portion, the cover portion and the hinge are made of silicone and are made as a single piece, the hinge consists of a thin connecting portion of the containing portion and the cover portion; and wherein the containing portion includes a perimetrical recess provided in the base of the cavity and suitable to house connecting means for said capsule.

BRIEF DESCRIPTION OF THE DRAWINGS

The characteristics and advantages of the invention are clearly evident from the following detailed description of a preferred embodiment/s thereof, with reference to the accompanying drawings, in which.

DESCRIPTION OF THE PREFERRED EMBODIMENTS

Figure 1:
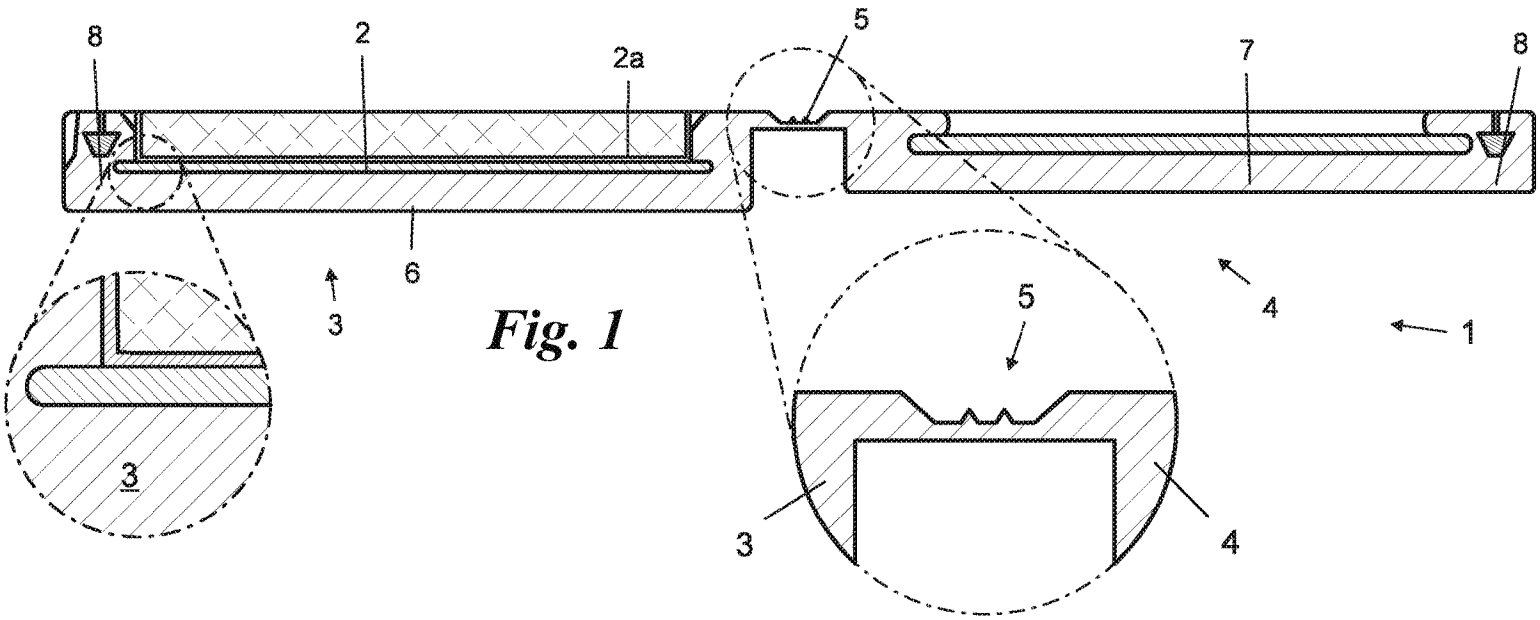
FIG. 1 shows a side view in sagittal cross-section of the container device according to the invention.
Figure 2:
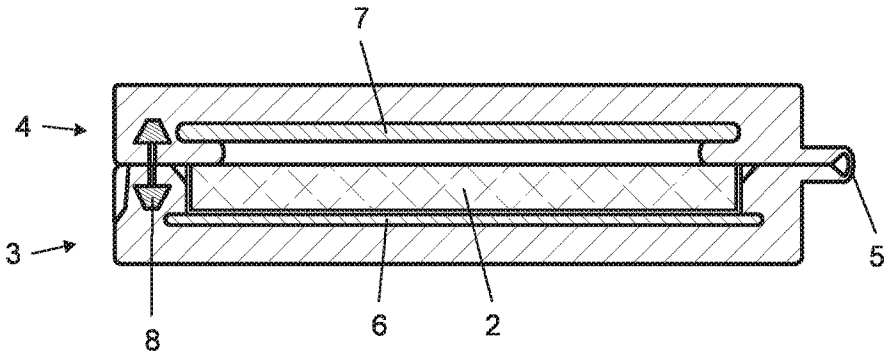
FIG. 2 shows a side view in sagittal cross-section of the container device according to the invention in a second configuration.
Figure 4:
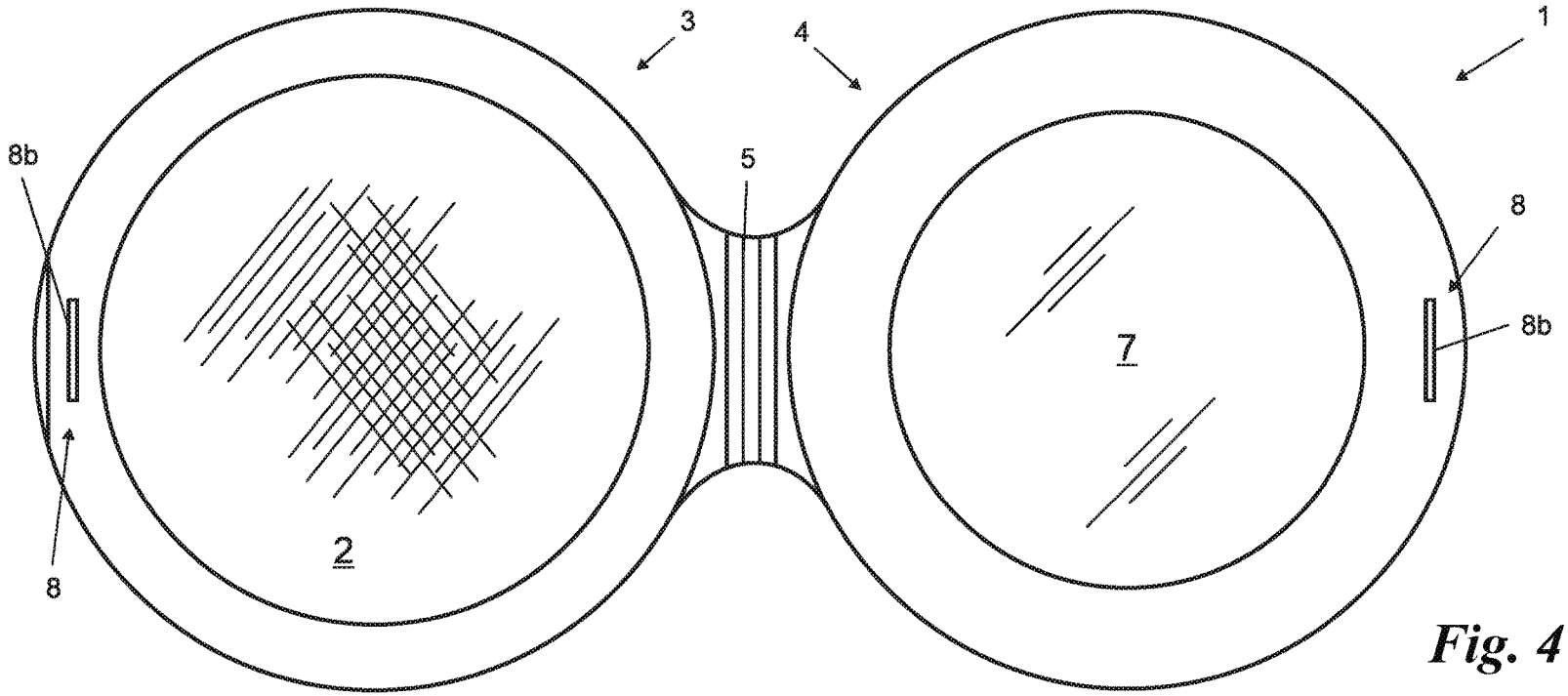
FIG. 4 is a view from above of the container device according to the invention.
Figure 3:
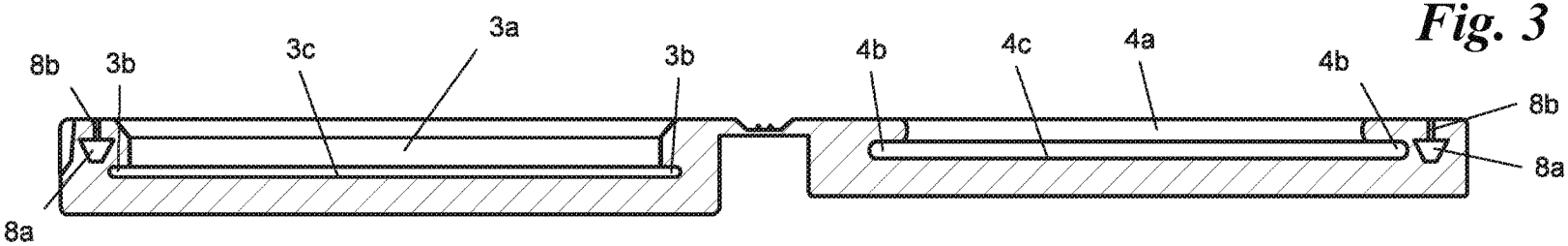
FIG. 3 shows a portion of the container device according to the invention.

With reference to said drawings, reference numeral 1 globally denotes the container device according to the invention.

It is suitable to contain cosmetics 2 and in particular solid cosmetics made from powdered or similar materials compacted into capsules, poured or otherwise. In particular disc-shaped, square or rectangular, or other shaped capsules, the overall shape of the device 1 is preferably also cylindrical.

The container 1 comprises, briefly, a containing portion 3 including a cavity 3*a* suitable to contain a capsule or similar 2, a cover portion 4 suitable to cover the containing portion 3, and a hinge 5 which connects the cover portion 4 to the containment portion 3.

Advantageously, the containing portion 3, the cover portion 4 and the hinge 5 are made of silicone and are in one piece. As known, silicone or polysiloxane comprises a family of inorganic polymers based on a silicon-oxygen chain and functional organic groups bound to the silicon atoms.

More in detail the containing portion 3 is preferably cylindrical in shape and contains said cavity 3*a*, also preferably cylindrical and counter-shaped to the capsule 2. The cavity 3*a* further defines a base 3*c*, where the capsule rests. At the perimeter of the base a perimetrical recess 3*b* is also provided on the base of the cavity 3*a*. The perimetrical recess 3*b* extends preferably for the entire perimeter, preferably circular, of the base 3*c*.

Figure 5:
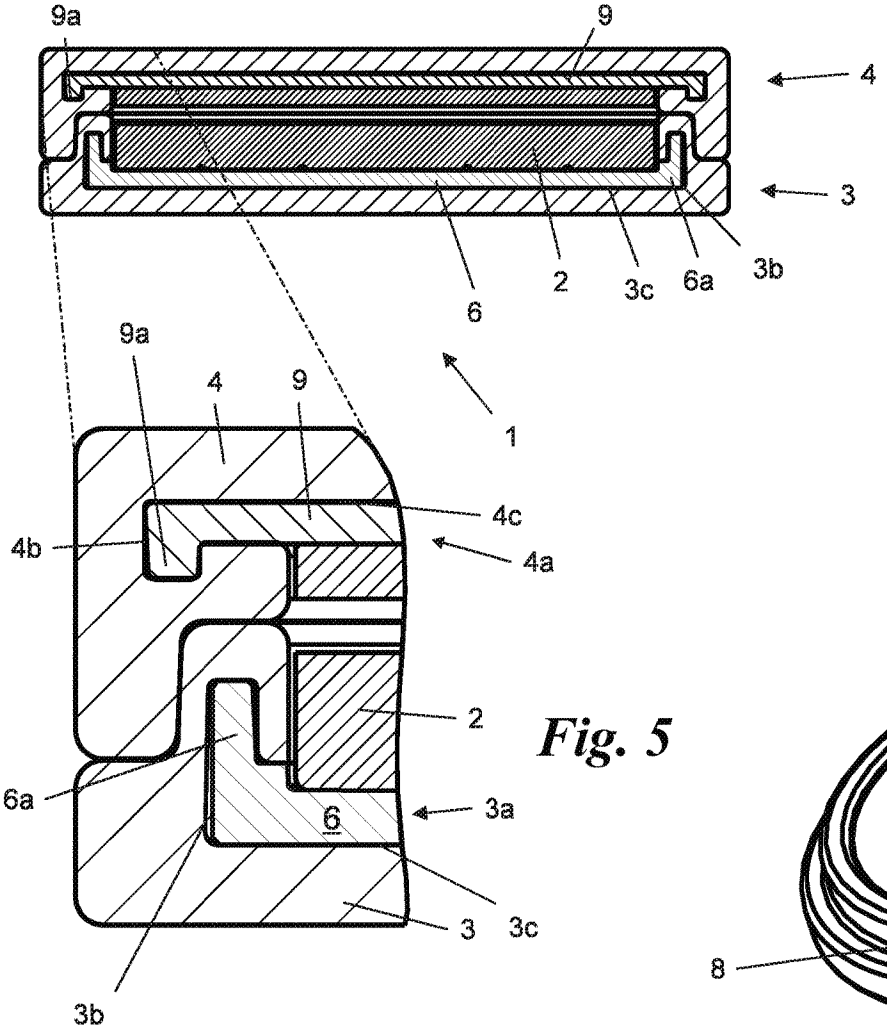
FIG. 5 is a side view in sagittal cross-section of the container device according to the invention in a second variant, with a magnification to scale of a portion of rim.

The perimetrical recess 3*b*, in a preferred solution, shown in FIG. 5 where the cross-section of said recess 3*b* is shown, is appropriately repeated all along the perimeter of the base. Said recess 3*b* comprises a diametrical portion substantially extending along the plane defined by the base, and an axial portion, extending in a direction at an angle with respect to the plane of the base 3*c*.

Said perimetrical recess 3*b* is suitable to house connecting means 6 for the capsule 2. Said connecting means 6 preferably consist of a rigid element, preferably of a rigid sheet, preferably in high-resistance polymer material such as loaded PA or the like, suitable to fit into the perimetrical recess 3*b*, preferably in the totality thereof, so as to stick to the base 3*c* and preferably cover the totality of said base 3*c*. Said sheet or disk is thus suitable to support a layer of glue and is thus appropriately glued to the capsule 2. In the case of FIG. 5 the connecting means also comprise a rim 6*a* at an angle, preferably perpendicular, appropriately counter-shaped to the recess 3*b* described. Alternatively, the connecting means are magnetic and the disc is therefore magnetic and supports a capsule with a metal rim.

The disk constituting the connecting means 6 is also substantially rigid, oppositely consists of a permanent magnet or an element including magnetic portions composed of permanent magnets and the like. Said magnetic element thus confers a greater rigidity to the containing portion 3.

The capsule 2 comprises a rigid base 2*a* preferably metallic and/or ferromagnetic or even possibly permanent magnets or similar. Or it is made of non-ferromagnetic rigid material and connected to the connecting means 6 using glue.

The cover portion 4 is also preferably cylindrical, with the same base area as the containing portion 3. It comprises a recess 4*a*, i.e. a recess or similar and a second perimetrical recess 4*b* having preferably all the characteristics of the perimetrical recess 3*b* and thus also the rim at an angle (FIG. 5).

The second perimetrical recess 4*b* is thus placed on the base 4*c* of the recess 4*a* and preferably extends for the entirety of the perimeter and is preferably circular. It is suitable to house, and preferably houses, a mirror 7, preferably also disc-shaped and rigid and suitable to fit into the entirety of the perimetrical recess 4*b*. The mirror 7 also thus extends preferably for the entirety of the base 4*c* of the recess 4*a*, possibly even of the angled rim, and stiffens the cover portion.

Before the mirror 7, second connecting means 9 may be provided for, preferably entirely similar to the first connecting means and thus consisting of a rigid sheet comprising a second angled rim 9*a* that fits, since appropriately counter-shaped thereto, into the recess 4*a* and into the perimetrical recess 4*b* possibly equipped with an angled axial portion (FIG. 5). A mirror 7 or similar is glued to said second connecting means 9.

The hinge 5 consists of a thin connecting portion of the containing portion 3 and the cover portion 4. The flexibility and elastic properties or silicone resilience, in fact allow the hinge 5 to be made in one piece with the portions 3 and 4. The term hinge is understood generically as any element which permits mutual rotation between the two portions.

The thinned portion preferably comprises a further central thinning and two prominences, so as to define preferred bending lines, as shown in FIG. 1.

The container device 1 further comprises closing means 8 suitable to constrain the cover portion 4 to the containing portion 3 away from the hinge 5 and preferably on the opposite side of the hinge 5, so as to close the portion 4 on the containing portion 3.

Said closing means 8 are preferably of the magnetic type. In particular a magnet is placed on said containing portion 3 and a magnet is placed on said cover portion 4. Alternatively, a single permanent magnet and ferromagnetic elements.

The magnet 8 or ferromagnetic element is preferably placed inside a seat 8*a*, inside the container device 1 and counter-shaped to the magnetic or ferromagnetic element. The seat 8*a* comprises a slit 8*b* bordering with the seat 8*a* and with the outside and suitable to permit the insertion of the magnet in the seat 8*a*. Moreover, the magnet 8 or ferromagnetic element preferably has a shape that is tapered towards one end and is suitable to be inserted through the slit 8*b* in the direction of the tapered end.

Figure 6:
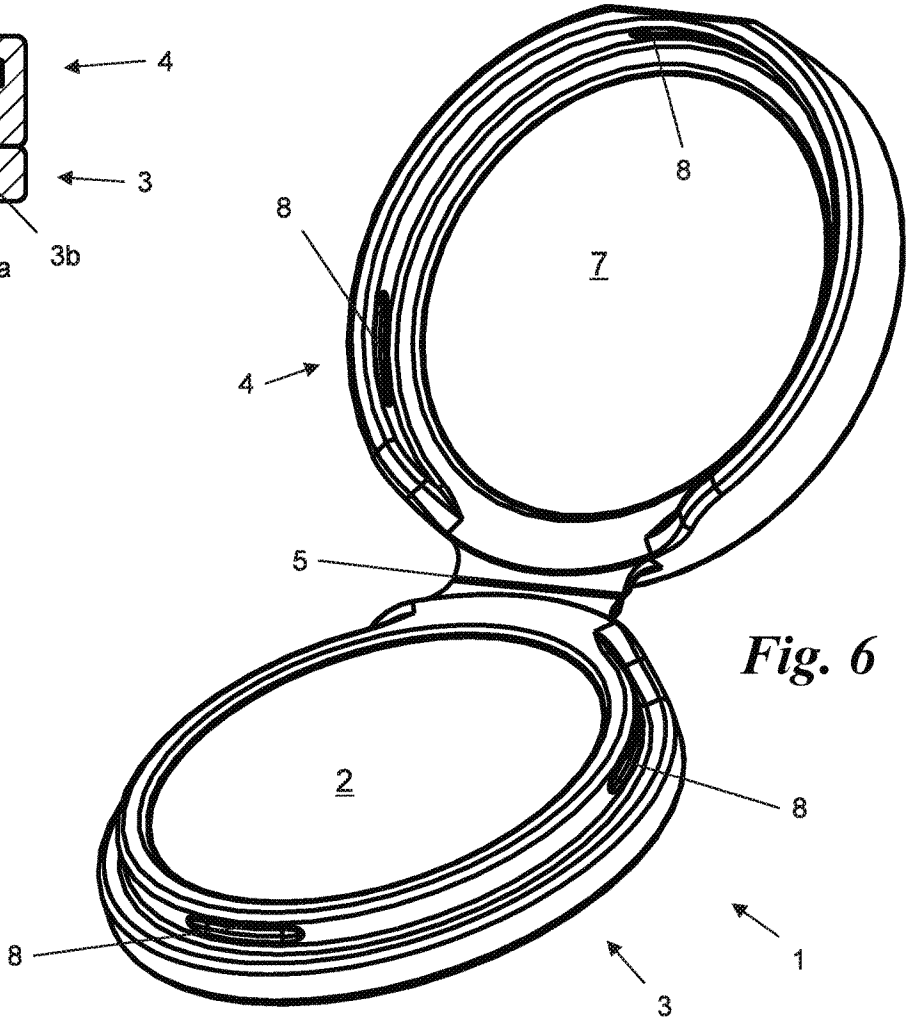
FIG. 6 shows a three-dimensional view of the example in FIG. 5.

Alternatively, as illustrated in FIG. 6, the closing means 8 are of the snap-fit type. They are preferably prominences and seats in the containing portion 3 and cover portion 4. Preferably they are three joints arranged symmetrically.

The magnets 8 and 6 and the mirror 7 may also be glued.

The use of a container device 1 as described above in a structural sense is analogous to the use of classic container devices in rigid polymer.

The invention achieves important advantages.

In particular, the container device 1 can resist shocks and falls, being very flexible and resilient.

Furthermore, the very flexibility and resilience of the container device 1 allows the protection of the internal elements, such as the mirror 7 and the capsule 2.

In addition, the flexibility and resilience is not at the expense of the strength and rigidity of the container, since the connecting means 6 and the mirror 7 lend rigidity to the assembly.

Said device is also simple and cheap, given that it permits moulding in one piece.

All the details may be replaced with equivalent elements and the materials, shapes and dimensions may be any within the scope of protection defined by the independent claims.

The invention claimed is:

1. A container device for cosmetics, comprising a containing portion including a cavity configured to contain a capsule constituting a cosmetic material, a cover portion configured to cover said containing portion, a hinge connecting said cover portion to said containing portion, wherein said containing portion, said cover portion and said hinge are made of silicone and are made as a single piece, said hinge consists of a thin connecting portion of said containing portion and said cover portion; and wherein said containing portion includes a perimetrical recess provided in the base of said cavity and configured to house connecting means for said capsule.

2. The container device as claimed in claim 1, wherein said cavity houses said connecting means consisting of a rigid element that is more rigid than the containing portion and the cover portion.

3. The container device as claimed in claim 2, wherein said perimetrical recess is arranged along the entire perimeter of said base and wherein said rigid element covers the whole of said base.

4. The container device as claimed in claim 3, wherein said perimetrical recess comprises a diametrical portion extending substantially along the plane defined by said base, and an axial portion, extending in a direction at an angle with respect to the plane of said base.

5. The container device as claimed in claim 4, wherein said rigid element is substantially counter-shaped to said perimetrical recess.

6. The container device as claimed in claim 1, wherein said cover portion comprises a recess and comprises a second perimetrical recess provided in the base of said recess and configured to house a mirror-.

7. The container device as claimed in claim 6, comprising second connecting means consisting of a rigid element inserted in said perimetrical recess.

8. The container device as claimed in claim 1, comprising closing means configured to connect said cover portion to said containing portion at a distance from said hinge, and wherein said closing means are of a magnetic type.

9. The container device as claimed in claim 1, wherein said closing means comprise a magnet arranged on said containing portion and a magnet arranged on said cover portion.

10. The container device as claimed in claim 1, wherein said closing means comprise a magnet and wherein said magnet is arranged within a seat, inside said container device, and wherein said seat comprises a slit bordering on said seat and with the outside and configured to permit the insertion of said magnet in said seat.

11. The container device as claimed in claim 10, wherein said magnet has a shape that is tapered towards one end and is configured to be inserted through said slit in the direction of said tapered end.

12. The container device as claimed in claim 1, comprising closing means configured to connect said cover portion to said containing portion and wherein said closing means, are of the snap-fit type.

13. The container device as claimed in claim 1, being substantially cylindrical in shape.

* * * * *